US007562716B2

(12) United States Patent
Lecanu et al.

(10) Patent No.: US 7,562,716 B2
(45) Date of Patent: Jul. 21, 2009

(54) DEVICE FOR PROTECTING PREMISES IN PARTICULAR A TUNNEL AGAINST FIRE

(76) Inventors: Pierre Lecanu, 7, chemin du Mont Desert, F-14400 Esquay sur Seulles (FR); Jean Lebreton, 21 Rue Maréchal Foch, 50100 Cherbourg (FR)

( * ) Notice: Subject to any disclaimer, the term of this patent is extended or adjusted under 35 U.S.C. 154(b) by 515 days.

(21) Appl. No.: 10/495,694

(22) PCT Filed: Nov. 20, 2002

(86) PCT No.: PCT/FR02/03967

§ 371 (c)(1),
(2), (4) Date: Sep. 27, 2004

(87) PCT Pub. No.: WO03/043701

PCT Pub. Date: May 30, 2003

(65) Prior Publication Data

US 2005/0028991 A1 Feb. 10, 2005

(30) Foreign Application Priority Data

Nov. 22, 2001 (FR) ..... 01 15113

(51) Int. Cl.
*A62C 37/08* (2006.01)
*B05B 7/06* (2006.01)

(52) U.S. Cl. ..... 169/37; 169/46; 169/51; 239/418; 239/424

(58) Field of Classification Search ..... 169/37, 169/42, 14, 16, 64, 66, 46, 51; 239/398, 239/399, 406, 418, 419.5, 428.5, 432, 424
See application file for complete search history.

(56) References Cited

U.S. PATENT DOCUMENTS

| | | | | | |
|---|---|---|---|---|---|
| 2,891,624 | A | * | 6/1959 | McBride | 169/44 |
| 3,128,036 | A | * | 4/1964 | McBride | 415/126 |
| 3,393,745 | A | | 7/1968 | Durstewitz | |
| 3,428,131 | A | * | 2/1969 | Winslow | 169/15 |
| 3,780,812 | A | * | 12/1973 | Lambert | 169/15 |
| 4,099,572 | A | | 7/1978 | Vasilenko et al. | |
| 4,276,064 | A | * | 6/1981 | Gerdes | 96/239 |
| 4,427,074 | A | * | 1/1984 | Wollin | 169/46 |

(Continued)

FOREIGN PATENT DOCUMENTS

| | | |
|---|---|---|
| DE | 2052863 | 5/1972 |

(Continued)

*Primary Examiner*—David Hwu
(74) *Attorney, Agent, or Firm*—Drinker, Biddle & Reath, LLP

(57) ABSTRACT

The invention concerns a device for protecting premises in particular a tunnel against fire, consisting of a circular housing open at its two ends and deisgned to be fixed in the upper part of the premises to be protected such that its median axis (XX') is substantially vertical, said housing comprising a substantially cylindrical lower part and an upper part substantially tapered in the shape of a bell, and containing part of vacuum-producing means capable of accelerating air circulation in and around the housing and spray means capable of injecting fine water droplets in the resulting circulating air.

6 Claims, 1 Drawing Sheet

U.S. PATENT DOCUMENTS 4,546,923 A * 10/1985 Ii ..... 239/406
4,834,188 A * 5/1989 Silverman ..... 169/65
5,305,548 A * 4/1994 Siebol ..... 47/2
6,086,053 A * 7/2000 Natschke et al. ..... 261/30
6,336,594 B1 * 1/2002 Bader et al. ..... 239/54
6,471,194 B2 * 10/2002 Keeney ..... 261/30

FOREIGN PATENT DOCUMENTS

FR 1545112 11/1968
GB 1219363 1/1971

* cited by examiner

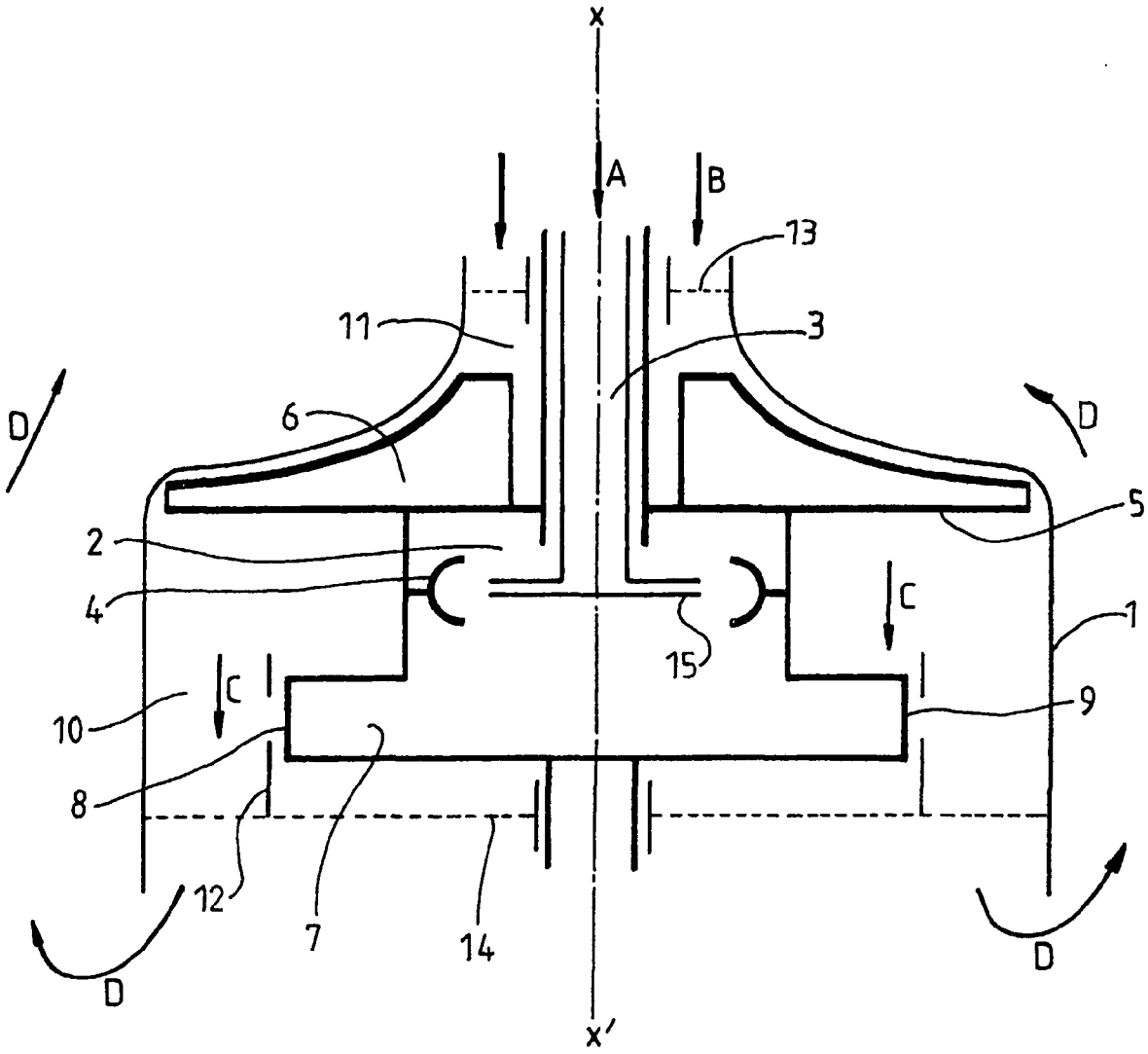
x
A
B
13
11
3
D
6
D
5
2
4
C
1
15
C
10
9
8
12
7
14
D
D
x'

DEVICE FOR PROTECTING PREMISES IN PARTICULAR A TUNNEL AGAINST FIRE

BACKGROUND

The present invention relates to a device for protecting premises, in particular a tunnel, against fire.

SUMMARY

The damage both human and material that can be caused by fire need hardly be described and specialists have long been attempting to propose means for combating this scourge.

To that end, the authorities have made it compulsory to equip some buildings, used privately or professionally, or some public places, with various types of extinguisher whose efficiency is unfortunately all too often inadequate.

By way of example, extinguishing devices have already been proposed for the purpose that operate by atomizing water and that are equipped with heads that generate droplets and that are supplied either with pressurized water or by a jet of water sheared by a gas, such as air.

Such devices operate in the following manner:

Owing to the heat which it releases, fire creates a temperature gradient which brings about a circulation of air promoting its propagation, because a fire cannot be propagated without the consumption of oxygen.

If fine droplets of water are injected, especially in the form of a spray, into the air circulating in the vicinity of a fire, they are sucked into the flames and evaporated, thus enabling the flames to be extinguished through lack of oxygen.

However, as a general rule, conventional heads of the above-mentioned type for generating water droplets have a flow rate of only from 2 to 20 l/min and can protect efficiently only a maximum volume of the order of 500 m3 with a height limitation of the order of 7 m, which is insufficient, in particular for the protection of high-risk or large premises, such as, for example, tunnels.

The object of the present invention is to propose a device for protecting premises against fire, which device has a markedly improved efficiency.

The device is characterized in that it is constituted by a housing generated by revolution which is open at its two ends and which is to be fixed in position at the upper portion of the premises to be protected in such a manner that its median axis is substantially vertical.

According to the invention, the housing comprises a substantially cylindrical lower portion and an upper portion narrowed substantially in the shape of a bell, and contains, on the one hand, vacuum-producing means capable of accelerating the circulation of air caused by the temperature gradient and by the thermal exchanges, especially by convection effect, and, on the other hand, atomizing means capable of injecting fine droplets of water into the air set in circulation.

The basic feature of the device according to the invention is associated with the presence of the vacuum-producing means which create a major partial vacuum by the application of the Bernoulli principle and thus permit the channelling and acceleration of the natural circulation of air generated by the fire owing to the presence of a temperature gradient.

If the air thus set in circulation is charged with fine droplets of water, the evaporation of the water is also accelerated, thus enabling the fire to be rapidly extinguished through lack of oxygen.

It should be noted that the device according to the invention may in some special cases correspond to semi-fixed equipment on a fire engine, in particular mounted at the end of an articulated arm or at the end of a telescopic arm and supplied with pressurized water. Such a device, which can be introduced above the seat of a fire or into the vicinity thereof, makes it easier for firemen to get closer in order to fight the fire.

According to a preferred feature of the invention, the vacuum-producing means are constituted by a disc which is centered on the median axis of the housing, is mounted substantially perpendicularly to that axis and is driven in rotation at high speed about that axis by a driving motor.

According to the invention, the disc is equipped on its upper face with a series of blades that have a variable cross-section and that extend into the narrowed upper portion of the housing in such a manner as to create a substantial partial vacuum and to enable air to be sucked in from the upper portion of the housing towards the lower portion thereof.

The use of rotary discs having a diameter of the order of one metre has afforded highly satisfactory protection of large premises.

In order to protect a tunnel, a housing of that type can advantageously be put in place approximately every 50 metres.

Such a configuration of the vacuum-producing means has the advantage of having a low manufacturing cost.

The driving motor of the disc can of course be of any type without departing from the scope of the invention and can operate with any source of power (electricity, gas, air, . . . ).

However, it is particularly advantageous to use for the purpose an action or reaction water turbine, such as a water turbine of the Pelton type or a water turbine of the Francis type.

The atomizing means too may be of any type and, by way of example, they may be constituted by conventional nozzles although the latter have the disadvantage of requiring the use of high-pressure pumps or of bottles of air.

Therefore, and according to a preferred feature of the invention, the atomizing means are constituted by a cylindrical centrifugal chamber mounted securely on the rotary disc in such a manner as to recover at least some of the water used in the turbine.

According to the invention, the chamber is equipped, on its peripheral wall, with calibrated orifices permitting the injection of fine droplets of water into the air set in circulation.

Bearing that configuration in mind, the water penetrating into the centrifugal chamber rotating at high speed is pressurized, thrown against the lateral walls of the chamber under the action of the centrifugal force and atomized in the form of fine droplets at the calibrated orifices. The water can therefore thus be injected into the air set in circulation by the vacuum-producing means, the speed of which is sufficiently high to enable the droplets to be sucked in.

According to the invention, the housing may also be equipped with a perforated fixed cylinder mounted opposite the orifices of the centrifugal chamber in order to facilitate the generation of the droplets of water.

According to another feature of the invention, the device comprises a fire detector co-operating with the atomizing means in order to control the injection of fine droplets of water into the air set in circulation.

According to a first variant, the detector may be a detection head of the sprinkler type which is known per se and which is constituted by a glass tube which contains a gas and which is fixed in position at the lower portion and the median portion of the housing.

Under the effect of the heat generated by a fire, such a tube explodes so as to free a mechanism capable of controlling the actuation of the atomizing means, in particular capable of opening the feed valve of the water turbine jets.

According to a second variant, such a detector may be constituted by a glass tube of the above-mentioned type which is positioned at the site most favourable for detecting fires and which is located on the control circuit of a diaphragm valve mounted upstream of the water supply duct for the atomizing means.

According to the invention, it is also possible to consider injecting atomized water or droplets of water into the air sucked in, directly at the upper portion of the housing in order to cool that air, which is at a high temperature.

In that case, it is advantageous to equip the housing, at its internal portion, with a radial chamber concentric with the blades in order to recover some of the water which has been injected upstream under the action of the centrifugal force.

During its injection into the air, the water has become charged with particles produced by combustion, thus providing slight filtering of the fumes.

It should be noted that the use of the device, to which the invention relates, in a tunnel, in particular one of great length, is particularly advantageous because, in a tunnel, there is generally a circulation of air which may be natural but which may also be forced by means of mechanical devices, such as fans.

When there is a fire in a tunnel, the pressure and the temperature increase locally.

The local excess pressure prevents any ventilation of the tunnel, and the fans, when present, become ineffective given that the fire has created a hot air lock.

The device to which the invention relates enables that disadvantage to be remedied owing to the major partial vacuum created, the effect of which is to channel the circulation of the air, while charging it with fine droplets of water.

The air is therefore cooled, and its density increases.

The air lock is consequently reduced and the mechanical or natural ventilation becomes effective again.

It is thus possible to protect a tunnel, even one of great length, against fire by the regular distribution of a series of devices according to the invention along the tunnel, at its upper portion.

Those devices do not necessarily enable a fire to be extinguished but they still have the advantage of preventing the creation of heat locks and permitting the intervention of firemen and the evacuation of people.

It should also be noted that tunnels are as a general rule surmounted by hills or mountains.

In this respect it is therefore advantageous to create, in an upper region, a storage basin of sufficient capacity whose water can be used to supply the atomizing means, in particular the ducts for supplying the jets of the water turbines of devices according to the invention for protection against fire.

For the difference in level enables the water to be pressurized.

It is thus possible to obtain an efficient and reliable system of protection against fire whose maintenance is easy and whose frost-proofing is simplified.

BRIEF DESCRIPTION OF THE DRAWING

The features of the device for protection against fire to which the invention relates will be described in more detail with reference to the appended figure.

FIG. 1 is a diagrammatic view of a non-limiting example of the configuration of such a device.

DETAILED DESCRIPTION

For the sake of clarity, in FIG. 1 the fixed elements have been represented with a fine line and the rotary elements have been represented with a thicker line.

According to FIG. 1, the protection device comprises a housing 1 generated by revolution which is open at its two ends and which is to be fixed in position at the upper portion of premises to be protected in such a manner that its median axis x-x' is substantially vertical.

To be more precise, the housing 1 comprises a cylindrical lower portion 10 which is extended at the top by a portion 11 which is narrowed in the shape of a bell.

The housing 1 also contains, at its internal portion, a turbine 2 of the Pelton type whose jets 15 are supplied with pressurized water in accordance with the arrow A by an axial duct 3 and whose bucket wheel 4 is fixedly joined to a disc 5 which is centered on the median axis x-x' of the housing 1 and mounted substantially perpendicularly to that axis. The rotary disc 5 is therefore driven in rotation at high speed by the turbine 2.

According to FIG. 1, the rotary disc 5 is mounted in the junction region between the cylindrical lower portion 10 and the upper portion 11, narrowed in the shape of a bell, of the housing 1 and is equipped on its upper face remote from the turbine 2 with a series of blades 6 that have a variable cross-section and that extend into the narrowed upper portion 11 of the housing 1.

The housing 1 also contains a cylindrical centrifugal chamber 7 which is driven in rotation at high speed by the bucket wheel 4 with the rotary disc 5 and which is mounted in such a manner as to recover at least some of the water used in the turbine 2.

The centrifugal chamber 7 is equipped on its peripheral wall 8 with a series of calibrated orifices 9.

The housing 1 is also equipped with a perforated fixed cylinder 12, which is mounted opposite the calibrated orifices 9 of the centrifugal chamber 7, and also with two grids 13, 14 which are mounted at the open ends of the housing 1 in order to act as filtration members.

The mode of operation of the device is the following:

The high-speed rotation of the blades 6 creates at the internal portion of the housing 1 a partial vacuum which causes air to be sucked in from the top towards the bottom in accordance with the arrows B. That air, which circulates in accordance with the arrows C at the internal portion of the housing 1, passes opposite the calibrated orifices 9 of the centrifugal chamber 7, before passing back up again in accordance with the arrows D along the external periphery of the housing 1.

Forced circulation of air in and around the housing 1 is thus created.

At the same time, under the action of the centrifugal force, the water coming from the turbine 2 is thrown against the lateral walls 8 of the chamber 7 and atomized at right-angles to the calibrated orifices 9 of that chamber in order to be injected into the air set in circulation in accordance with the arrows C opposite those orifices.

The fixed tube 12 located at right-angles to the calibrated orifices 9 facilitates the generation of the droplets.

The invention claimed is:

1. A process for protecting premises, in particular a tunnel, against fire, by the injection of fine droplets of water into the air circulating near a fire so that they are drawn into the flames and vaporize whereby the fire dies out because of a shortage of oxygen, comprising:

fixing a housing generated by revolution which is open at its two ends in position at the upper portion of the premises to be protected in such a manner that its median axis is substantially vertical, the housing comprising a substantially cylindrical lower portion and an upper portion narrowed substantially in the shape of a bell;

channeling and accelerating the circulation of air generated by the fire in and around the housing using a disc which is centered on the median axis of die housing, is mounted substantially perpendicularly to that axis and is driven in rotation at high speed about that axis by a driving motor constituted by an action or reaction water turbine such as a water turbine of the Pelton type or a water turbine of the Francis type, the disc being equipped on its upper face with a series of blades that have a variable cross-section and that extend into the narrowed upper portion of the housing in such a manner as to create a partial vacuum and to enable air to be sucked in from the upper portion of the housing towards the lower portion thereof; and injecting fine droplets of water into the air thus set in accelerated circulation using a cylindrical chamber mounted securely on the rotary disc in such a manner as to recover at least some of the water used in the turbine, the chamber being equipped on its peripheral wall with calibrated orifices permitting the injection of the fine droplets of water into the air set in circulation.

2. A process according to claim 1, wherein the housing is equipped with a perforated fixed cylinder mounted opposite the orifices of the centrifugal chamber in order to facilitate the generation of the droplets of water.

3. A device for protecting premises, in particular a tunnel, against fire, comprising:

a housing generated by revolution which is open at its two ends and which is to be fixed in position at the upper portion of the premises to be protected in such a manner that its median axis (xx') is substantially vertical, the housing comprising a substantially cylindrical lower portion and an upper portion narrowed substantially in the shape of a bell;

the housing containing vacuum-producing means capable of accelerating the circulation of air in and around the housing and constituted by a disc which is centered on the median axis (xx') of the housing, is mounted substantially perpendicularly to that axis and is driven in rotation at high speed about that axis by a driving motor constituted by an action or reaction water turbine such as a water turbine of the Pelton type or a water turbine of the Francis type;

the disc being equipped on its upper face with a series of blades that have a variable cross-section and that extend into the narrowed upper portion of the housing in such a manner as to create a partial vacuum and to enable air to be sucked in from the upper portion of the housing towards the lower portion thereof; and atomizing means capable of injecting fine droplets of water into the air thus set in circulation and constituted by a cylindrical chamber mounted securely on the rotary disc in such a manner as to recover at least some of the water used in the turbine, the chamber being equipped on its peripheral wall with calibrated orifices permitting the injection of fine droplets of water into the air set in circulation.

4. A device according to claim 3, wherein the housing is equipped with a perforated fixed cylinder mounted opposite the orifices of the centrifugal chamber in order to facilitate the generation of the droplets of water.

5. A device for protecting premises, in particular a tunnel, against fire, comprising:

a housing generated by revolution about an axis that is open at its two ends and that is to be fixed in position at the upper portion of the premises to be protected in such a manner that the axis of the housing is substantially vertical, the housing comprising a substantially cylindrical portion and a portion narrowed substantially in the shape of a bell, the housing arranged in use to be fixed in position at an upper portion of the premises to be protected in such a manner that the axis of the housing is substantially vertical, the substantially cylindrical portion is a lower portion, and the narrowed portion is an upper portion, the housing containing a vacuum-producer comprising a disc that is centered on the axis of the housing, is mounted substantially perpendicularly to that axis and in use is driven in rotation at high speed about that axis by a driving motor comprising a water turbine of the Pelton type or a water turbine of the Francis type, the disc being equipped on its face towards the narrowed upper portion of the housing with a series of blades that have a variable cross-section and that extend into the narrowed upper portion of the housing in such a manner as to create a partial vacuum in the narrowed portion of the housing enabling air to be sucked in from the upper portion of the housing towards the lower portion thereof and accelerating the circulation of air in through the housing from one open end to the other and around the housing, and an atomizer comprising a cylindrical chamber mounted securely on the rotary disc in such a manner as to recover at least some of the water used in the turbine, the chamber being equipped on its peripheral wall with calibrated orifices permitting the injection of fine droplets of water into the air thus set in accelerated circulation.

6. A device according to claim 5, further comprising a perforated fixed cylinder mounted opposite the orifices of the centrifugal chamber in order to facilitate the generation of the droplets of water.

* * * * *